US007900611B2

(12) United States Patent
Okada

(10) Patent No.: US 7,900,611 B2
(45) Date of Patent: Mar. 8, 2011

(54) APPARATUS AND METHOD FOR TREATING BLOW-BY GAS FOR INTERNAL COMBUSTION ENGINE

(75) Inventor: Naoya Okada, Kasugai (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 68 days.

(21) Appl. No.: 12/411,927

(22) Filed: Mar. 26, 2009

(65) Prior Publication Data

US 2009/0241922 A1 Oct. 1, 2009

(30) Foreign Application Priority Data

Mar. 26, 2008 (JP) ..... 2008-081407

(51) Int. Cl.
*F01M 13/00* (2006.01)
*F01M 11/10* (2006.01)

(52) U.S. Cl. ..... 123/572

(58) Field of Classification Search ..... 123/572–574; 701/104

See application file for complete search history.

(56) References Cited

U.S. PATENT DOCUMENTS

| | | | | |
|---|---|---|---|---|
| 3,589,347 | A * | 6/1971 | Sawada | 123/574 |
| 2007/0156322 | A1 * | 7/2007 | Soga et al. | 701/104 |
| 2008/0257320 | A1 * | 10/2008 | Asanuma et al. | 123/573 |

FOREIGN PATENT DOCUMENTS

| | | | |
|---|---|---|---|
| DE | 197 04 461 | C1 | 5/1998 |
| DE | 101 63 780 | A1 | 7/2003 |
| JP | 2004-346881 | | 12/2004 |
| JP | 2006-274931 | | 10/2006 |
| JP | 2006-299929 | | 11/2006 |

OTHER PUBLICATIONS

Office Action issued Jun. 21, 2010, in German Patent Application No. 10 2009 001 865.4-13, filed Mar. 25, 2009.

* cited by examiner

*Primary Examiner* — M. McMahon

(74) *Attorney, Agent, or Firm* — Oblon, Spivak, McClelland, Maier & Neustadt, L.L.P.

(57) ABSTRACT

A total amount of engine oil carried from a crankcase into an intake passage by blow-by gas from the start of the use of the internal combustion engine or the engine oil is calculated. It is determined whether the total oil carried amount is greater or less than an optimum value every predetermined operation period of the internal combustion engine. Then, when it is determined that the total oil carried amount is greater than the optimum value, the gas flow rate of the blow-by gas controlled based on the engine operation state is reduced until next determination process is performed. When it is determined that the total oil carried amount is less than the optimum value, the gas flow rate is increased until next determination process is performed.

8 Claims, 5 Drawing Sheets

APPARATUS AND METHOD FOR TREATING BLOW-BY GAS FOR INTERNAL COMBUSTION ENGINE

INCORPORATION BY REFERENCE

The disclosure of Japanese Patent Application No. 2008-081407 filed on Mar. 26, 2008 including the specification, drawings and abstract is incorporated herein by reference in its entirety.

BACKGROUND OF THE INVENTION

1. Field of the Invention

This invention relates to an apparatus and method for treating blow-by gas of an internal combustion engine.

2. Description of the Related Art

In an internal combustion engine built into a vehicle such as an automobile, gas containing fuel components and exhaust components (blow-by gas) leaks out of the combustion chamber into the crankcase through a space between the cylinder inner wall and the piston ring during the drive of the vehicle. Therefore, as Japanese Patent Application Publication No. 2006-299929 (JP-A-2006-299929) discloses, the internal combustion engine is provided with a blow-by gas treatment apparatus which returns the blow-by gas leaking out of the combustion chamber into the crankcase to an intake passage to treat the blow-by gas, and controls the gas flow rate of the blow-by gas based on the engine operation state.

Here, it is preferred to increase the gas flow rate as much as possible in order to let the blow-by gas within the crankcase flow promptly into the intake passage, for the purpose of preventing the oil accumulated in the crankcase from being deteriorated when the exhaust components and unburned fuel components of the blow-by gas leaking out of the combustion chamber are mixed into the oil. However, excessive increase of the gas flow rate results in increase of the amount of oil carried from the crankcase to the intake passage by the blow-by gas, which consequently increases the amount of deposit adhered to the intake passage due to this oil.

Therefore, the gas flow rate of the blow-by gas that is returned to the intake passage by the blow-by gas treatment apparatus is controlled on the basis of the engine operation state and set at an optimum value based on, for example, the two points described above. Specifically, the idea considered is to control the gas flow rate on the basis of the engine operation state to a value at which the progression degree of oil deterioration within the crankcase is kept at a standard level and at which the amount of deposit adhered to the intake passage by the blow-by gas carrying the oil to the intake passage is kept at an acceptable level.

Incidentally, even when the gas flow rate of the blow-by gas returned to the intake passage is controlled based on the engine operation state as described above, it is difficult to achieve, at high levels, suppression of the adhesion of the deposit to the intake passage caused by the blow-by gas carrying the oil to the intake passage, and suppression of the oil deterioration by treating the blow-by gas within the crankcase early. This is associated with the fact that the amount of oil carried into the intake passage by the blow-by gas is changed by how the driver of the vehicle operates the internal combustion engine and the individual difference of the internal combustion engine.

Specifically, in a case in which the amount of oil carried into the intake passage by the blow-by gas is greater than average, when the gas flow rate is controlled based on the engine operation state, although the progression degree of oil deterioration within the crankcase is kept at the standard level, the amount of deposit adhered to the intake passage by the blow-by gas carrying the oil to the intake passage exceeds the acceptable level.

On the other hand, in a case in which the amount of oil carried into the intake passage by the blow-by gas is lower than average, when the gas flow rate is controlled based on the engine operation state, the amount of deposit adhered to the intake passage by the blow-by gas carrying the oil to the intake passage considerably exceeds the acceptable level. In other words, the amount of deposit adhered to the intake passage can be kept at the acceptable level even when increasing the gas flow rate of the blow-by gas returned to the intake passage. Consequently, the progression degree of oil deterioration within the crankcase can be further kept lower than the standard level by increasing the gas flow rate. However, controlling the gas flow rate based on the engine operation state is not enough to realize the abovementioned increase of the gas flow rate, and thus the progression degree of oil deterioration within the crankcase cannot be further kept lower than the standard level.

As described above, controlling the gas flow rate based on the engine operation state does not take into consideration the fact that the amount of oil carried into the intake passage by the blow-by gas is changed by how the driver of the vehicle operates the internal combustion engine. For this reason, it is difficult to suppress the adhesion of the deposit to the intake passage and the oil deterioration within the crankcase at high levels.

SUMMARY OF THE INVENTION

The invention provides an apparatus and method for treating blow-by gas for an internal combustion engine, the apparatus and method suppressing the adhesion of deposit to an intake passage caused when oil is carried to the intake passage, and suppressing the oil deterioration by treating blow-by gas within the crankcase early.

A first aspect of the invention is a blow-by gas treatment apparatus for an internal combustion engine, which returns blow-by gas leaking out of a combustion chamber of the internal combustion engine into a crankcase, to an intake passage, and controls a gas flow rate of the blow-by gas on the basis of an engine operation state. The blow-by gas treatment apparatus has: a calculation part that calculates a total amount of engine oil carried from the crankcase into the intake passage by the blow-by gas based on the engine operation state from the start of the use of the internal combustion engine or the engine oil; a determination part that performs a determination process as to whether the total oil carried amount is greater or less than an optimum value every predetermined operation period of the internal combustion engine; and a correction part that reduces the gas flow rate of the blow-by gas returned to the intake passage until next determination process is carried out when it is determined that the total oil carried amount is greater than the optimum value, and that increases the gas flow rate until next determination process is carried out when it is determined that the total oil carried amount is less than the optimum value.

The amount of oil carried from the crankcase to the intake passage by the blow-by gas varies depending on how the internal combustion engine is operated or the individual difference of the internal combustion engine. Therefore, even when the gas flow rate of the blow-by gas is controlled based on the engine operation state, it is not always true that suppression of the adhesion of the deposit to the intake passage caused by the blow-by gas carrying the oil to the intake passage, and suppression of the oil deterioration by treating the blow-by gas within the crankcase early may be achieved at high levels.

For example, in a case in which the amount of oil carried into the intake passage is greater than average, when the gas flow rate is controlled based on the engine operation state, although the progression degree of oil deterioration within the crankcase is kept at the standard level, the amount of deposit adhered to the intake passage might exceed the acceptable level. In this case, however, it is determined that the total oil carried amount is greater than the optimum value, and consequently the gas flow rate of the blow-by gas is reduced until the next determination process is carried out. As a result, the amount of oil carried into the intake passage is reduced, whereby the amount of deposit adhered to the intake passage may be prevented from exceeding the acceptable level.

On the other hand, in a case in which the amount of oil carried into the intake passage is lower than average, when the gas flow rate is controlled based on the engine operation state, the amount of deposit adhered to the intake passage is considerably below the acceptable level. In other words, the amount of deposit adhered to the intake passage can be kept at the acceptable level even when increasing the gas flow rate of the blow-by gas. Consequently, the progression degree of oil deterioration within the crankcase can be further kept lower than the standard level due to increase of the gas flow rate. In this case, it is determined that the total oil carried amount is less than the optimum value, and consequently the gas flow rate of the blow-by gas is increased until the next determination process is carried out. As a result, the blow-by gas within the crankcase can be treated early, and the progression degree of oil deterioration within the case caused by the blow-by gas can be further made lower than the standard level.

As described above, the gas flow rate of the blow-by gas is increased based on the determination made by the determination process as to whether the total oil carried amount is greater or less than the optimum value. Accordingly, it is possible to achieve, at high levels, suppression of the adhesion of the deposit to the intake passage, and suppression of the oil deterioration.

In the first aspect described above, the correction part may set the degree of reduction or of increase of the gas flow rate of the blow-by gas to the degree corresponding to a divergence amount for the optimum value of the total oil carried amount.

According to the above configuration, it is determined that the total oil carried amount is greater than the optimum value, and when the gas flow rate of the blow-by gas is reduced based on the determination, the degree of the reduction is set to the degree corresponding to a divergence amount for the optimum value of the total oil carried amount. As a result, the larger the divergence amount for the optimum value of the total oil carried amount, the more the gas flow rate of the blow-by gas is reduced. Accordingly, the amount of oil carried into the intake passage is reduced by the amount corresponding to the divergence amount for the optimum value of the total oil carried amount. Then, the amount of deposit adhered to the intake passage by the oil carried to the intake passage can be prevented appropriately from exceeding the acceptable level. Also, the oil deterioration within the crankcase that is caused by the blow-by gas within the crankcase can be suppressed as much as possible, while keeping the maximum gas flow rate of the blow-by gas.

On the other hand, when the gas flow rate of the blow-by gas is increased based on the fact that it is determined that the total oil carried amount is less than its optimum value, the degree of the increase is set to the degree corresponding to a divergence amount for the optimum value of the total oil carried amount. As a result, the larger the divergence amount for the optimum value of the total oil carried amount, the more the gas flow rate of the blow-by gas is increased. The blow-by gas within the crankcase can be treated as early as possible, and the progression degree of oil deterioration within the crankcase that is caused by the blow-by gas can be kept lower than the standard level as much as possible. In addition, when increasing the gas flow rate, although the amount of oil carried from the crankcase increases, the amount of deposit adhered to the intake passage by the oil is prevented from exceeding the acceptable level.

As described above, the degree of reduction or of increase of the gas flow rate may be set to the degree corresponding to the divergence amount for the optimum value of the total oil carried amount, whereby the adhesion of the deposit to the intake passage and oil deterioration within the crankcase can be suppressed at higher levels.

In the embodiments described above, an oil life system may be applied to the internal combustion engine, and the oil life system may calculate deterioration progress of the oil within the crankcase based on the engine operation state during each predetermined period, obtain the degree of oil deterioration by accumulating the calculated deterioration progress, and warn about oil deterioration when the degree of oil deterioration becomes an threshold value or higher. The correction part may increase the deterioration progress when the gas flow rate of the blow-by gas is reduced, and reduce the deterioration progress when the gas flow rate is increased.

Reducing the gas flow rate of the blow-by gas by means of the correction part delays the treatment of the blow-by gas present in the crankcase. Consequently, the oil deterioration progresses within the crankcase. As a result, the actual degree of oil deterioration becomes greater than the degree of oil deterioration obtained by the oil life system, and there might arise a problem that the oil life system warns about the oil deterioration later than the appropriate time. However, according to this configuration, when reducing the gas flow rate of the blow-by gas, the calculated deterioration progress is increased. Consequently, the degree of oil deterioration obtained by the oil life system is set to be greater in accordance with the actual degree of oil deterioration within the crankcase that increases as the gas flow rate is reduced. Therefore, the abovementioned problem that the oil life system warns about the oil deterioration later than the appropriate time can be avoided.

Moreover, when the gas flow rate of the blow-by gas is increased, the blow-by gas within the crankcase is treated early, delaying the oil deterioration within the crankcase. As a result, the actual degree of oil deterioration becomes less than the degree of oil deterioration obtained by the oil life system, and there might arise a problem that the oil life system warns about the oil deterioration earlier than the appropriate time. However, according to this configuration, when increasing the gas flow rate of the blow-by gas, the calculated deterioration progress is reduced. Consequently, the degree of oil deterioration obtained by the oil life system is suppressed from increasing in accordance with the actual degree of oil deterioration within the crankcase that is suppressed from increasing as the gas flow rate is increased. Therefore, the abovementioned problem that the oil life system warns about the oil deterioration earlier than the appropriate time can be avoided.

In addition, the correction part may set the degree of reduction or of increase of the gas flow rate of the blow-by gas to the degree corresponding to the divergence amount for the optimum value of the total oil carried amount, and set the degree of increase or of reduction of the deterioration progress to the degree corresponding to the divergence amount.

According to this configuration, when increasing or reducing the deterioration progress that is calculated using the oil life system as the gas flow rate of the blow-by gas is reduced or increased, the degree of increase or of reduction of the deterioration progress is set to the degree corresponding to the degree of correction of the gas flow rate. Consequently, the degree of oil deterioration obtained by the oil life system is set at a value corresponding accurately to the actual degree of oil deterioration that changes as the gas flow rate is reduced or increased. Therefore, it is possible to prevent more accurately the oil life system from warning about the oil deterioration earlier or later than the appropriate time.

The correction part may increase or reduce the deterioration progress by multiplying a ratio between the total oil carried amount and the optimum value by the deterioration progress.

According to this configuration, the greater the total oil carried amount is with respect to the optimum value, the greater the ratio between the total oil carried amount and the optimum value becomes with respect to "1.0." In addition, the lower the total oil carried amount is with respect to the optimum value, the lower the ratio between the total oil carried amount and the optimum value becomes with respect to "1.0." According to this configuration, the abovementioned ratio with such characteristics is multiplied by the deterioration progress to increase or reduce the deterioration progress. Therefore, the degree of increase or of reduction of the deterioration progress can be made correspond to the divergence amount corresponding to the optimum value of the total oil carried amount.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
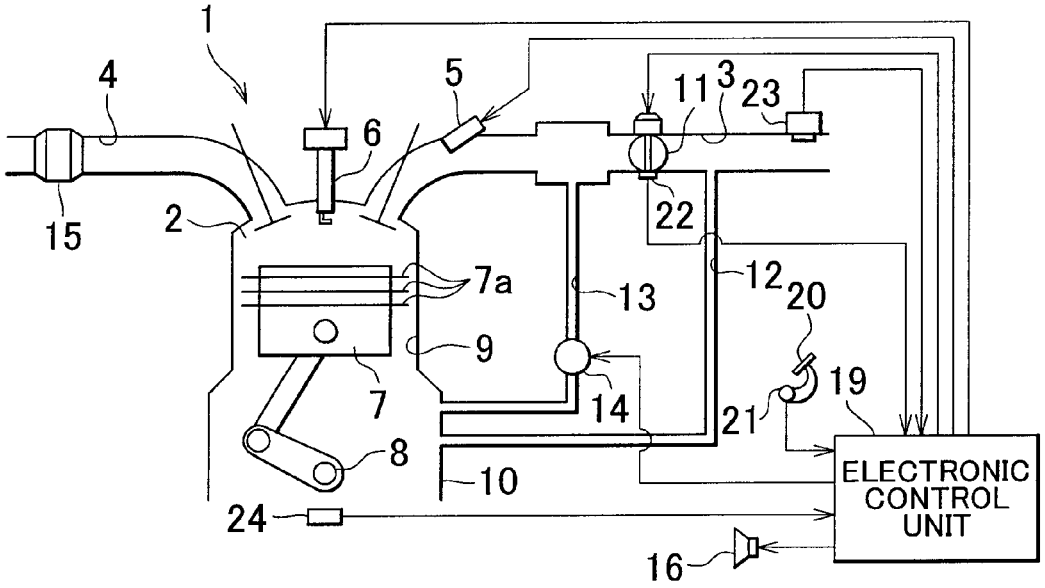
FIG. 1 is a schematic diagram showing the entire engine to which a blow-by gas treatment apparatus of an embodiment.
Figure 2:
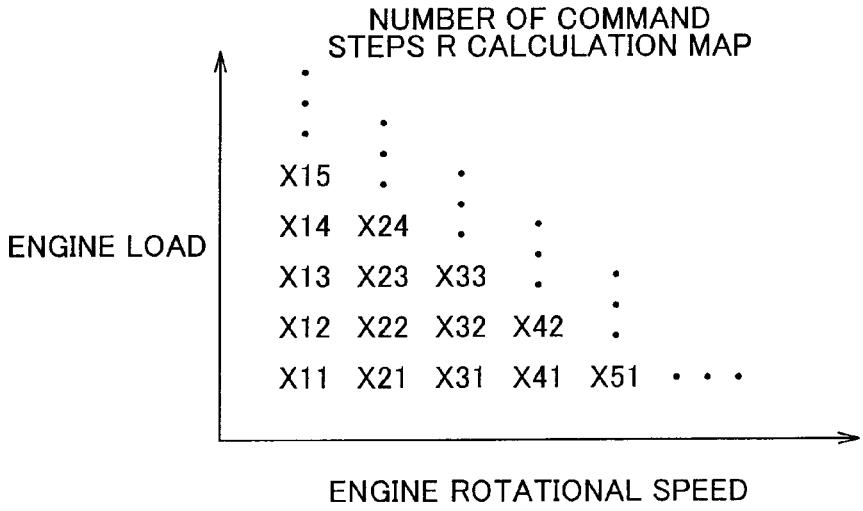
FIG. 2 is a map used for calculating the number of command steps R representing operation command values of a PCV valve.

An embodiment applied to an engine of an automobile is described hereinafter with reference to FIGS. 1 to 7. In an engine 1 shown in FIG. 1, an intake passage 3 and exhaust passage 4 are connected to a combustion chamber 2 of each cylinder. Air is drawn into the combustion chamber 2 through the intake passage 3 provided with a throttle valve 11 for adjusting the intake airflow, and fuel is injected and supplied from a fuel injection valve 5 into the intake passage 3, whereby a mixture of air and fuel fills the combustion chamber 2. When this mixture is combusted by igniting a spark plug 6 within each cylinder, a piston 7 is reciprocated by a combustion energy generated by this combustion, thereby rotating a crankshaft 8 functioning as an output shaft of the engine 1. In addition, the combusted mixture is sent as exhaust to the exhaust passage 4 and cleaned by a catalyst 15 provided in the exhaust passage 4.

In the engine 1, some of the gas existing in the combustion chamber 2 leaks out of a space between a piston ring 7*a* and a cylinder inner wall 9 into a crankcase 10 during a compression stroke and expansion stroke, in the form of blow-by gas. Therefore, the engine 1 is provided with a blow-by gas treatment apparatus for returning the blow-by gas that leaks out of the combustion chamber 2 to the intake passage 3 and treats the blow-by gas.

This apparatus has a fresh air introducing passage 12 for introducing fresh air into the crankcase 10 connected to an upstream section of the throttle valve 11 of the intake passage 3, and a gas outflow passage 13 that is connected to a downstream section of the throttle valve 11 of the intake passage 3 to return the blow-by gas within the crankcase 10 to the intake passage 3. The gas outflow passage 13 is provided with a pressure-control valve (PCV) 14 for adjusting gas flow rate when returning the blow-by gas to the intake passage 3. This PCV valve 14 is electrically operated and has its opening adjusted by a stepping motor or the like. Adjusting the opening to the opening side increases the flow rate of gas flowing from the gas outflow passage 13 to the intake passage 3. In this apparatus, the blow-by gas that leaks out of the combustion chamber 2 into the crankcase 10 is returned to the intake passage 3 via the gas outflow passage 13 by introducing fresh air from the fresh air introducing passage 12 into the crankcase 10.

In the engine 1, exhaust components and unburned fuel components of the blow-by gas leaking out of the combustion chamber 2 are mixed into the oil accumulated within the crankcase 10, whereby the oil is deteriorated. Therefore, it is desired that the oil be replaced at appropriate time before the oil deterioration progresses, so that the engine 1 is not operated with the deteriorated oil. In order to cope with this situation, an oil life system which obtains a degree of oil deterioration within the crankcase 10 on the basis of the engine operation state, and warns about the oil deterioration when the degree of oil deterioration becomes an threshold value or higher may be applied to the engine 1. Note that the oil life system warns about the oil deterioration using a warning tone of an alarm device 16 provided in the driver's seat of an automobile.

By applying the oil life system to the engine 1, the warning tone is issued from the alarm device 16 to the driver of the automobile when the degree of oil deterioration becomes at least the threshold value as the oil deterioration progresses within the crankcase 10. Therefore, by replacing the oil based on the warning tone issued by the alarm device 16, the oil can be replaced at appropriate time before the oil deterioration progresses, so that the engine 1 is not operated with the deteriorated oil.

An electrical configuration of the blow-by gas treatment apparatus is described next. The blow-by gas treatment device has an electronic control unit 19 for executing various control relating to the engine 1 built into the automobile. This electronic control unit 19 is configured by a central processing unit (CPU) for executing various computation processes relating to the various control, a read only memory (ROM) for storing programs and data obtained for performing the various control, a random access memory (RAM) for temporarily storing the results of computation and the like performed by the CPU, and input/output ports for inputting/outputting signals to/from the outside.

The following sensors and the like described below are connected to the input port of the electronic control unit 19: an accelerator position sensor 21 for detecting an depression amount (accelerator depression amount) of an accelerator pedal 20 that is stepped on and operated by the driver of the automobile; a throttle position sensor 22 for detecting the opening of the throttle valve 11 (throttle opening) provided in the intake passage 3 of the engine 1; an airflow meter 23 for detecting the amount of air drawn into the combustion chamber 2 through the intake passage 3; and a crank position sensor 24 for outputting a signal corresponding to the rotation of the crankshaft 8.

Drive circuits of various devices, such as the fuel injection valve 5, spark plug 6, throttle valve 11, PCV valve 14, and alarm device 16, are connected to the output port of the electronic control unit 19.

The electronic control unit 19 outputs a command signal to the drive circuit of each device connected to the output port, in response to the engine operation state that is comprehended by a detection signal input from each sensor. Consequently, ignition timing control of the spark plug 6, control of the opening of the throttle valve 11, control of fuel injection performed by the fuel injection valve 5, control of the opening of the PCV valve 14, and control of drive of the alarm device 16 are executed by the electronic control unit 19.

Here, an overview of control of the drive of the alarm device 16 and an overview of the control of the opening of the PCV valve 14 will be described below.

The drive of the alarm device 16 is controlled in order to warn about the oil deterioration by means of the oil life system applied to the engine 1. Every predetermined period, the oil life system calculates deterioration progress B of the oil within the crankcase 10 during the predetermined period, on the basis of the engine operation state, such as the engine rotational speed and engine load. Then, when the degree of oil deterioration ΣB representing the accumulation of the values that are each obtained by calculating the deterioration progress B is at least a threshold value, the alarm device 16 is driven and caused to issue the warning tone to the driver of the automobile. The engine rotational speed that is used for calculating the deterioration progress B is obtained based on a detection signal from the crank position sensor 24. The engine load is calculated from the engine rotational speed and a parameter corresponding to the intake airflow of the engine 1. As the parameter corresponding to the intake airflow to be used here, for example, an actual measurement value of the intake airflow of the engine 1 that is obtained based on a detection signal from the airflow meter 23 can be used.

The opening of the PCV valve 14 is controlled based on the number of command steps R representing operation command values obtained by the electronic control unit 19, for the purpose of controlling the gas flow rate of the blow-by gas returned from the crankcase 10 to the intake passage 3 via the gas outflow passage 13. Specifically, the number of command steps R is calculated by referring to a map shown in FIG. 2, based on the engine operation state, such as the engine rotational speed and the engine load, and then an opening/closing operation is performed on the PCV valve 14 based on the calculated number of command steps R. When controlling the opening of the PCV valve 14, the opening is closed completely when the number of command steps R is "0," and the opening is adjusted to the opening side as the number of command steps increases from "0." By controlling the opening of the PCV valve 14, the gas flow rate of the blow-by gas flowing from the crankcase 10 to the intake passage 3 via the gas outflow passage 13 is controlled.

With regard to the gas flow rate of the blow-by gas, it is preferred to increase the gas flow rate as much as possible in order to let the blow-by gas within the crankcase 10 flow promptly into the intake passage 3, for the purpose of preventing the oil accumulated in the crankcase 10 from being deteriorated when the exhaust components and unburned fuel components of the blow-by gas leaking out of the combustion chamber 2 are mixed into the oil. However, excessive increase of the gas flow rate results in increase of the amount of oil, of the oil accumulated in the crankcase 10, which is carried from the crankcase 10 to the intake passage 3 by the blow-by gas, which consequently increases the amount of deposit adhered to the intake passage 3 due to this oil.

Therefore, the number of command steps R that is used for controlling the gas flow rate of the blow-by gas is calculated based on the engine operation state, such as the engine rotational speed and the engine load, so that the gas flow rate is set at an optimum value based on the two points described above. Specifically, the number of command steps R is calculated based on the engine rotational speed and the engine load so that the gas flow rate of the blow-by gas is set at a value at which the progression degree of oil deterioration within the crankcase is kept at a standard level and at which the amount of deposit adhered to the intake passage 3 by the blow-by gas carrying the oil to the intake passage is kept at an acceptable level.

Incidentally, even when calculating the number of command steps R based on the engine rotational speed and the engine load as described above and controlling the gas flow rate of the blow-by gas by controlling the opening of the PCV valve 14 based on the number of command steps R, it is difficult to achieve, at high levels, prevention of the adhesion of the deposit and prevention of the progress of the oil deterioration. This is associated with the fact that the amount of oil carried from the crankcase 10 to the intake passage 3 by the blow-by gas is changed by how the driver of the automobile operates the engine 1 and the individual difference of the engine 1.

In a case in which the amount of oil carried from the crankcase 10 to the intake passage 3 by the blow-by gas is greater than average due to the difference in how the driver operates the engine 1 and the individual difference of the engine 1, even when the gas flow rate of the blow-by gas is controlled by controlling the opening of the PCV valve 14, oil deterioration and the deposit adhesion described above occur in the following situation. Specifically, when controlling the gas flow rate of the blow-by gas, although the progression degree of oil deterioration within the crankcase 10 can be kept at the standard level, the amount of deposit adhered to the intake passage 3 by the blow-by gas carrying the oil to the intake passage 3 exceeds the acceptable level.

In addition, in a case in which the amount of oil carried from the crankcase 10 to the intake passage 3 by the blow-by gas is lower than average due to the difference in how the driver operates the engine 1 and the individual difference of the engine 1, even when the gas flow rate of the blow-by gas is controlled, oil deterioration and the deposit adhesion described above occur in the following situation. Specifically, the amount of deposit adhered to the intake passage 3 by the blow-by gas carrying the oil from the crankcase 10 to the intake passage 3 is considerably below the acceptable level, as a result of control performed on the gas flow rate of the blow-by gas. In other words, the amount of deposit adhered to the intake passage 3 can be kept at the acceptable level even when increasing the gas flow rate of the blow-by gas returned to the intake passage 3. Consequently, the progression degree of oil deterioration within the crankcase 10 can be further kept lower than the standard level by increasing the gas flow rate. However, controlling the gas flow rate of the blow-by gas is not enough to realize the abovementioned increase of the gas flow rate, and thus the progression degree of oil deterioration within the crankcase 10 cannot be further kept lower than the standard level.

As described above, controlling the gas flow rate of the blow-by gas does not take into consideration the fact that the amount of oil carried into the intake passage 3 by the blow-by gas is changed by how the driver operates the engine 1. For this reason, it is difficult to prevent the adhesion of the deposit to the intake passage 3 and the oil deterioration within the crankcase 10 at high levels.

In this embodiment, therefore, the total oil carried amount ΣA of the oil carried from the crankcase 10 to the intake passage 3 by the blow-by gas from the start of the use of the engine 1 or the engine oil is calculated, and a determination process is performed, every predetermined operation period of the engine 1, as to whether the total oil carried amount ΣA is greater or less than an optimum value KX thereof at the predetermined operation period. Then, the number of command steps R is corrected so as to be reduced or increased on the basis of the result of the determination process. By correcting the opening of the PCV valve 14 to the closing side or the opening side on the basis of the corrected number of command steps R, the gas flow rate of the blow-by gas is corrected.

More specifically, when it is determined by the determination process that the total oil carried amount ΣA is greater than the optimum value KX, the number of command steps R that is calculated based on the engine rotational speed and the engine load is subjected to the reduction correction until the next determination process is carried out. Then, by correcting the opening of the PCV valve 14 to the closing side on the basis of the corrected number of command steps R, the gas flow rate of the blow-by gas is subjected to the reduction correction. As a result, the amount of oil carried from the crankcase 10 to the intake passage 3 by the blow-by gas can be reduced, and the amount of deposit adhered to the intake passage 3 by the oil can be suppressed from exceeding the acceptable level.

When it is determined by the determination process that the total oil carried amount ΣA is less than the optimum value KX, the number of command steps R that is calculated based on the engine rotational speed and the engine load is subjected to the increase correction until the next determination process is carried out. Then, by correcting the opening of the PCV valve 14 to the opening side on the basis of the corrected number of command steps R, the gas flow rate of the blow-by gas is subjected to increase correction. As a result, the blow-by gas within the crankcase 10 can be treated early, whereby the progression degree of oil deterioration within the crankcase 10 that is caused by the gas can be kept lower than the standard level.

Even when the amount of oil carried to the intake passage 3 by the blow-by gas is changed by the difference in how the operator operates the engine 1, suppression of the adhesion of the deposit to the intake passage 3 and suppression of the oil deterioration within the crankcase 10 can be achieved at high levels by correcting the gas flow rate of the blow-by gas in the manner described above.

Figure 3:
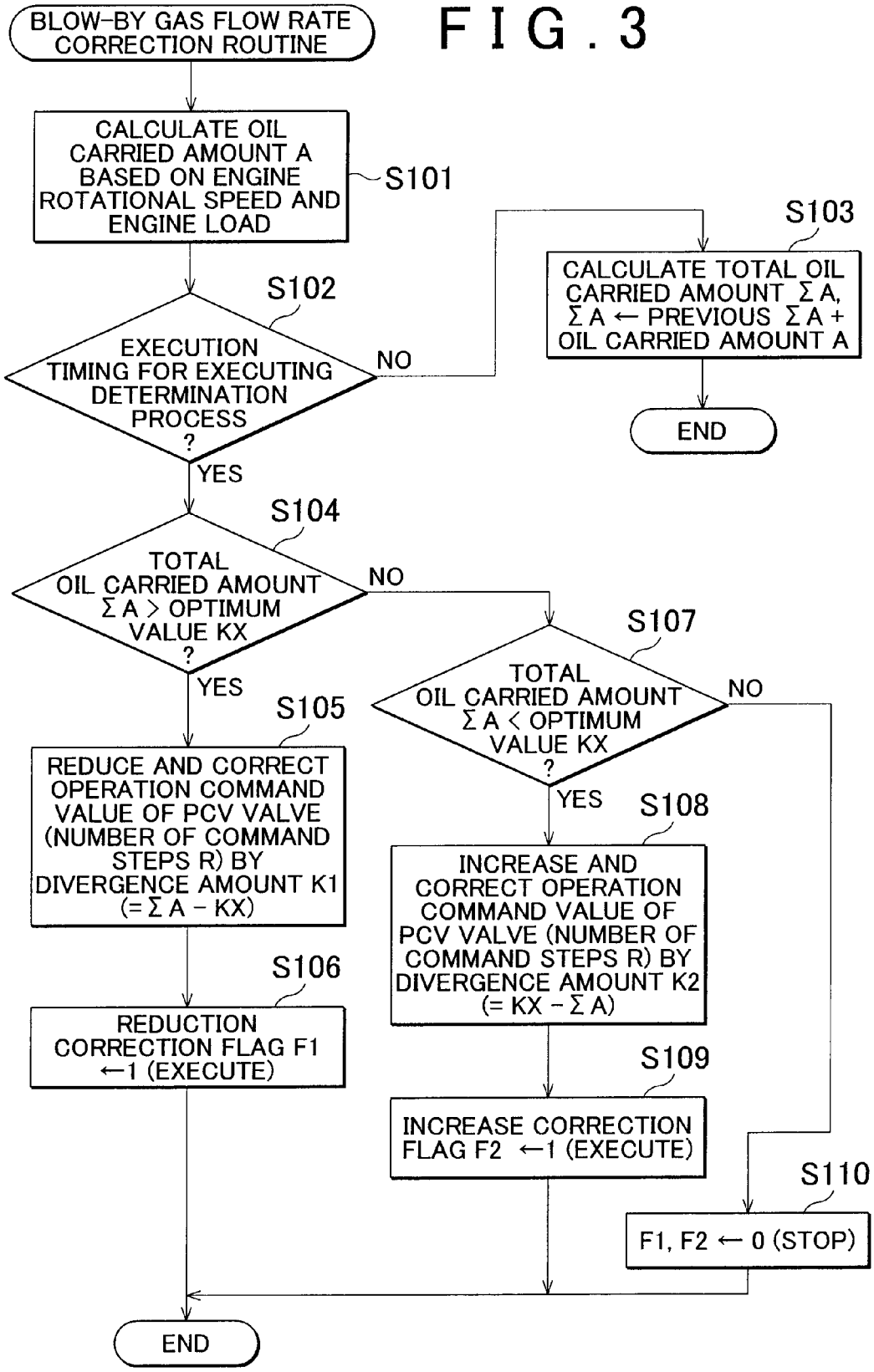
FIG. 3 is a flowchart showing a procedure for correcting the gas flow rate of blow-by gas.

Next, a procedure for correcting the gas flow rate of the blow-by gas is described with reference to the flowchart of FIG. 3 showing a blow-by gas flow rate correction routine. The electronic control unit 19 executes this blow-by gas flow rate correction routine periodically, that is, the routine is an interrupt routine executed every predetermined period (every 16 ms, for example).

Figure 4:
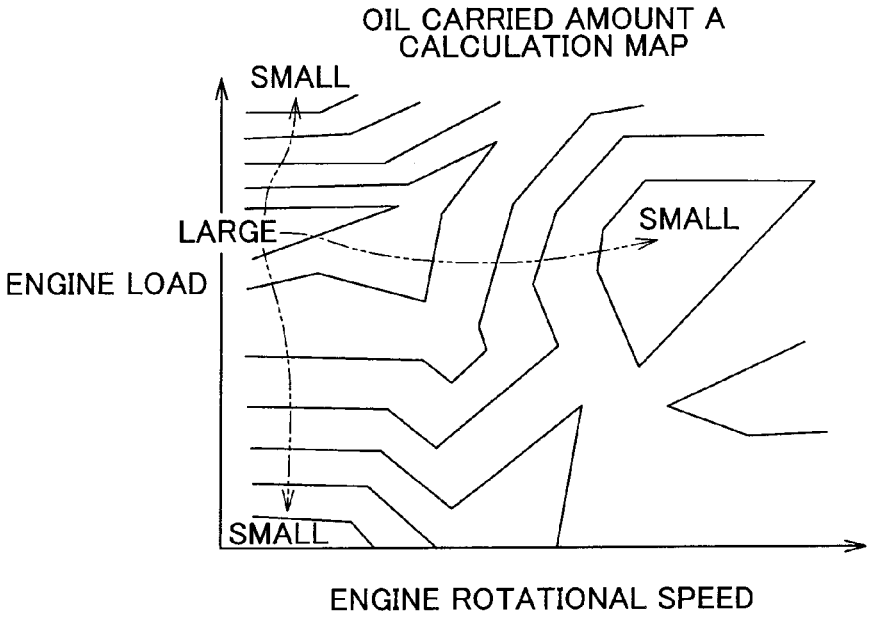
FIG. 4 is a map used for calculating the oil carried amount A.
Figure 5:
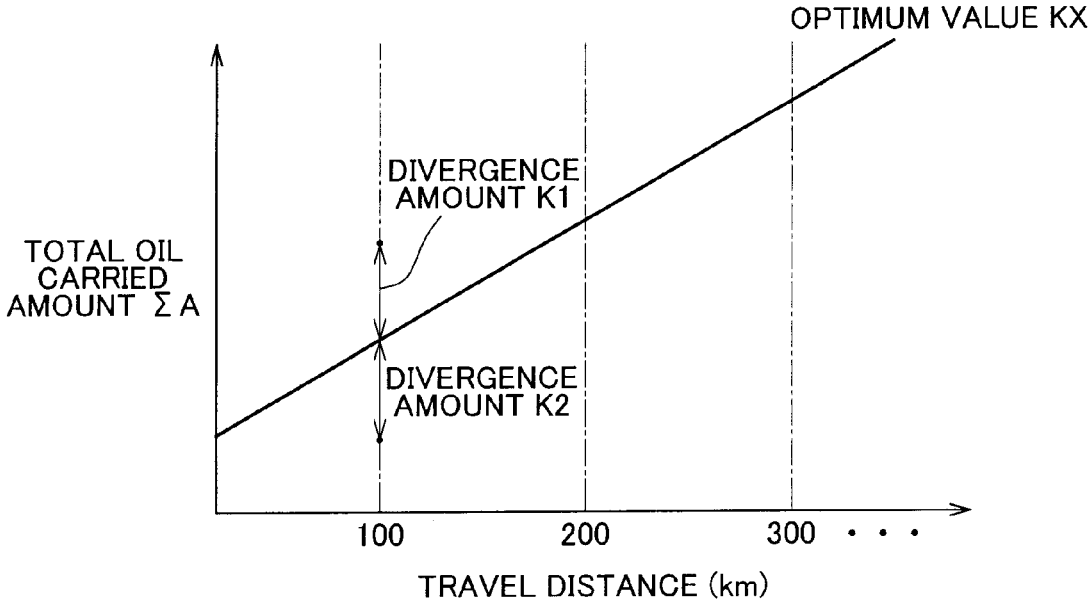
FIG. 5 is a graph showing the relationship among the total oil carried amount ΣA, optimum value KX, and divergence amount K1, K2.

In this routine, first, the oil carried amount A representing the amount of oil carried from the crankcase 10 to the intake passage 3 by the blow-by gas during an execution cycle of the routine is calculated based on the engine rotational speed and the engine load, with reference to a map shown in FIG. 4 that is defined previously by an experiment or the like (S101). Next, determination is made as to whether the timing is the execution timing for executing the determination process (S102 in FIG. 3), that is, whether the travel distance of the automobile reaches a distance that is a factor of 100 km (100, 200, 300 km . . . ).

When it is determined in step S102 that the timing is not the execution timing for executing the determination process, the total oil carried amount ΣA representing the accumulation of the values that are each obtained by calculating the oil carried amount A is calculated from the start of the use of the engine 1 (S103). Specifically, the value that is obtained by adding the oil carried amount A calculated in step S101 to the previous total oil carried amount ΣA is calculated as the present total oil carried amount ΣA. Note that this total oil carried amount ΣA is stored in the nonvolatile RAM of the electronic control unit 19 every time it is calculated, and the value stored in the RAM is used as the previous value.

On the other hand, when it is determined in step S102 that the timing is the execution timing for executing the determination process, a process for performing the reduction correction or increase correction on the gas flow rate of the blow-by gas flowing from the crankcase 10 to the intake passage 3 (S104 to S110) is executed when the total oil carried amount ΣA is greater than or less than the optimum value KX thereof at the moment. Note that the optimum value KX is calculated as shown in, for example, FIG. 5 by referring to a map that is defined previously by an experiment or the like based on the travel distance of the automobile.

In this series of processes of steps S104 to S110 described above, determination is made as to whether the total oil carried amount ΣA is greater than the optimum value KX obtained based on the travel distance at the moment (S104). If the result of the determination is positive, the number of command steps R representing the operation command value of the PCV valve 14 is corrected by a divergence amount K1 (=ΣA−KX) of the total oil carried amount ΣA with respect to the optimum value KX so as to close the valve 14 (reduction) (S105). Then, the gas flow rate of the blow-by gas is reduced by the divergence amount K1, based on the corrected number of command steps R. Thereafter, a reduction correction flag F1 used for determining whether the gas flow rate is reduced or not is set at "1 (execute)" (S106).

When, on the other hand, the result of the determination performed in step S104 is negative, determination is made as to whether the total oil carried amount ΣA is less than the optimum value KX obtained based on the travel distance at the time (S107). When the result of the determination here is positive, the number of command steps R representing the operation command value of the PCV valve 14 is corrected by a divergence amount K2 (=KX−ΣA) of the total oil carried amount ΣA with respect to an optimum value KX so as to open the valve 14 (correction to the increase side) (S108). Then, the gas flow rate of the blow-by gas is increased by the divergence amount K2 based on the corrected number of command steps R. Thereafter, an increase correction flag F2 used for determining whether the gas flow rate is increase or not is set at "1 (execute)" (S109).

Note that when the results of the determination is negative in both steps S104 and S107, it means that the total oil carried amount ΣA coincides with the optimum value KX obtained based on the travel distance at the moment. In this case, the number of command steps R is subjected to neither the reduction correction nor increase correction, and therefore the gas flow rate of the blow-by gas subjected to neither the reduction correction nor increase correction. Therefore, the reduction correction flag F1 and the increase correction flag F2 are set at "0 (stop)" (S110).

Figure 6:
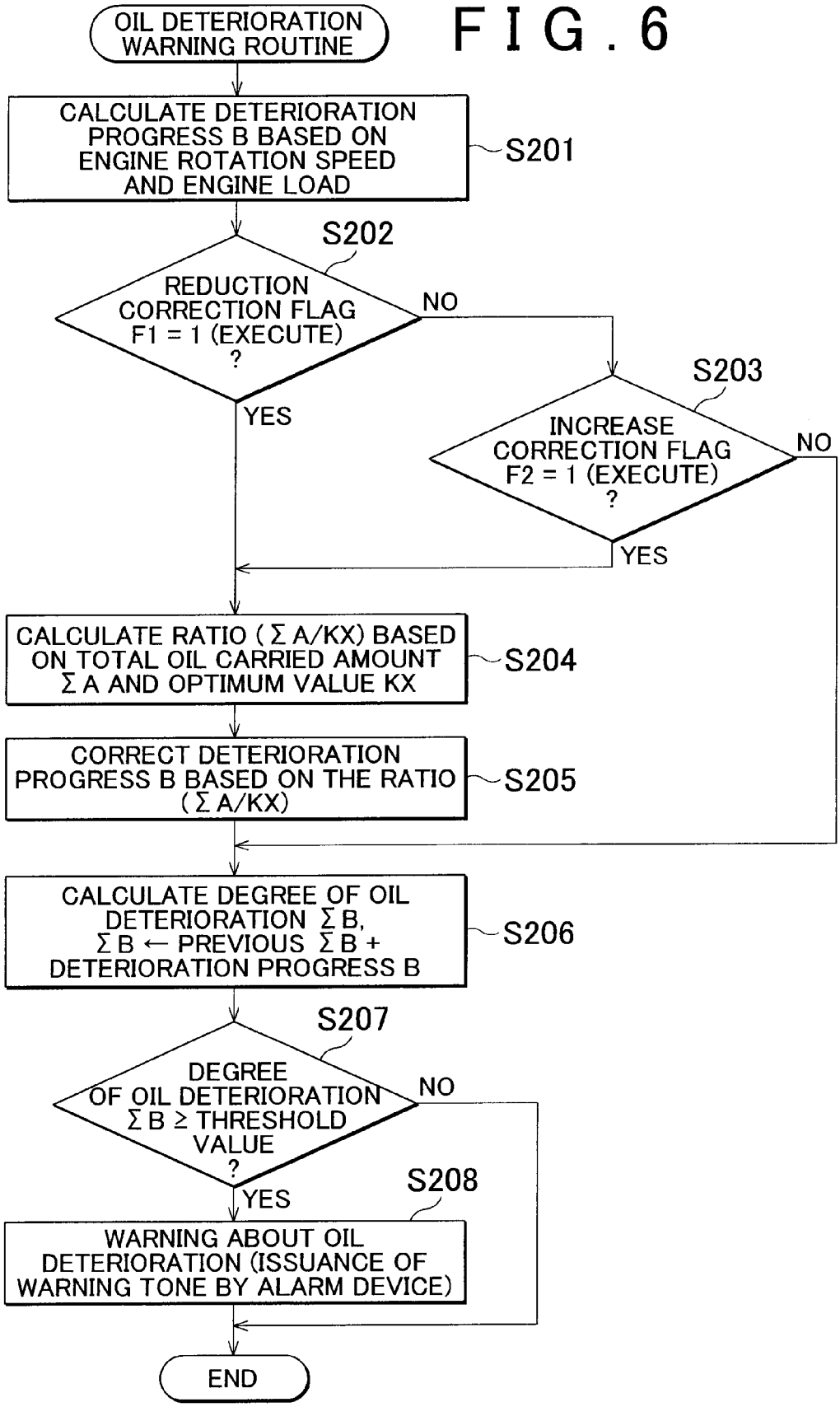
FIG. 6 is a flowchart showing a procedure for executing oil deterioration warning of an oil life system.

Next, a procedure for executing oil deterioration warning by means of the oil life system is described with reference to the flowchart of FIG. 6 showing an oil deterioration warning routine. Note that the electronic control unit 19 executes this oil deterioration warning routine periodically, that is, the routine is an interruption routine executed every predetermined period (every 16 ms, for example).

In this routine, the deterioration progress B representing how much the oil within the crankcase 10 is deteriorated during the execution cycle of the routine is calculated based on the engine rotational speed and the engine load, with reference to the map that is defined previously by an experiment or the like (S201). This deterioration progress B is used for calculating the degree of oil deterioration ΣB. The degree of oil deterioration ΣB is the accumulation of the values that are each obtained by calculating the deterioration progress B, and is calculated by adding the deterioration progress B to the degree of oil deterioration ΣB (S206). Note that the degree of oil deterioration ΣB is stored in the nonvolatile RAM of the electronic control unit 19 every time it is calculated, and the value stored in the RAM is used as the previous value.

When the degree of oil deterioration ΣB becomes at least the threshold value (S207: YES), the alarm device 16 is driven and caused to issue the warning tone to the driver of the automobile (S208). Therefore, by replacing the oil based on the warning tone issued by the alarm device 16, the oil can be replaced at appropriate time before the oil deterioration progresses, so that the engine 1 is not operated with the deteriorated oil. Note that the degree of oil deterioration ΣB is returned to "0" by performing an initialization process for resetting the degree of oil deterioration ΣB to "0" when the oil replacement is carried out in the engine 1. In order to conduct this initialization process, for example, the driver's seat is provided with a reset switch for resetting the degree of oil deterioration ΣB to the initial value "0." The idea considered is to employ the initialization process in which the driver operates the reset switch when the oil replacement is carried out and the electronic control unit 19 resets the degree of oil deterioration ΣB to "0" based on the operation.

Incidentally, when the gas flow rate of the blow-by gas is corrected through the blow-by gas flow rate correction routine (FIG. 3), the treatment of the blow-by gas present in the crankcase 10 is delayed or advanced, and consequently the actual progress of deterioration of the oil within the crankcase 10 is also advanced or delayed. As a result, the actual degree of oil deterioration becomes different from the degree of oil deterioration ΣB obtained by the oil life system. Accordingly, warning about the oil deterioration or issuance of the warning tone by the alarm device 16 is executed at inappropriate time when the degree of oil deterioration ΣB becomes at least the threshold value.

In order to cope with this situation, in the oil deterioration warning routine (FIG. 6), there is executed a process for correcting the deterioration progress B calculated based on the engine rotational speed and the engine load, by the amount corresponding to the amount of correction of the gas flow rate of the blow-by gas (S202 to S205). By calculating the degree of oil deterioration ΣB using the corrected deterioration progress B (S206), the degree of oil deterioration ΣB becomes a value corresponding to the actual degree of oil deterioration, also when correcting the gas flow rate of the blow-by gas. As a result, when correcting the gas flow rate of the blow-by gas, it is possible to prevent the abovementioned problem in which the warning about the oil deterioration or issuance of the warning tone by the alarm device 16 is executed at inappropriate time when the degree of oil deterioration ΣB becomes at least the threshold value.

Below is described in detail a process for correcting the deterioration progress B by the amount corresponding to the amount of correction of the gas flow rate of the blow-by gas (S202 to S205).

In this series of processes, determination is made as to whether the reduction flag F1 is "1 (execute)" or not (S202) and whether the increase correction flag F2 is "1 (execute)" Or not (S203). When the result of the determination in either the step S202 or step S203 is positive, that is, when either the reduction correction or increase correction is performed on the gas flow rate, the deterioration progress B that is calculated based on the engine rotational speed and the engine load is corrected by the amount corresponding to the divergence amount K1 or divergence amount K2. More specifically, the ratio between the total oil carried amount ΣA and the optimum value KX used in the steps S104, S107 and the like in FIG. 3 (ΣA/KX) is calculated based on the total oil carried amount ΣA and the optimum value KX (S204). Thereafter, the ratio (ΣA/KX) is multiplied by the deterioration progress B so that the deterioration progress B is corrected by the amount corresponding to the divergence amount K1 or divergence amount K2 (S205).

Here, when the reduction correction flag F1 is "1 (execute)" and the reduction correction is executed on the gas flow rate, the treatment of the blow-by gas present in the crankcase 10 is delayed, accelerating the progress of oil deterioration within the crankcase 10. As a result, the actual degree of oil deterioration becomes greater than the degree of oil deterioration ΣB obtained by the oil life system, and the warning about the oil deterioration (issuance of the warning tone by the alarm device 16) that is performed when the degree of oil deterioration ΣB becomes at least the threshold value might be performed later than the appropriate time.

However, when the reduction correction is executed on the gas flow rate, the total oil carried amount ΣA is greater than the optimum value KX. Consequently, the ratio (ΣA/KX) becomes greater than "1.0." Therefore, the deterioration progress B is increased by multiplying the ratio (ΣA/KX) by the deterioration progress B. In addition, the greater the total oil carried amount ΣA is than the optimum value KX, that is, the greater the divergence amount K1, the greater the ratio (ΣA/KX) is than "1.0." Thus, the amount of increase correction performed on the deterioration progress B accurately corresponds to the divergence amount K1.

Figure 7:
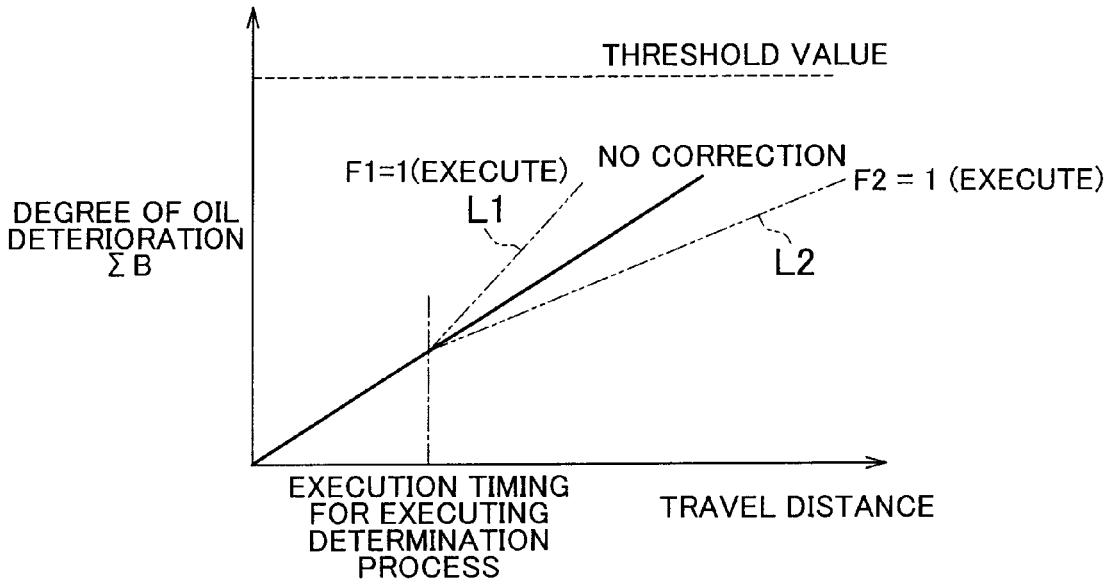
FIG. 7 is a graph showing a transition of the degree of oil deterioration ΣB with respect to an increase in a travel distance.

By calculating the degree of oil deterioration ΣB using the increased deterioration progress B, the degree of oil deterioration ΣB is set to be greater in accordance with the actual degree of oil deterioration within the crankcase 10 that increases as the gas flow rate is reduced, as shown by the two-dot chain line L1 in FIG. 7. The solid line in the drawing indicates a transition of the degree of oil deterioration ΣB with respect to the travel distance when neither the reduction correction nor increase correction is performed on the gas flow rate. In this manner, it is possible to prevent the abovementioned problem in which the warning about the oil deterioration (issuance of the warning tone by the alarm device 16) is executed later than the appropriate time.

In addition, when the reduction correction flag F2 is "1 (execute)" and the increase correction is executed on the gas flow rate, the treatment of the blow-by gas present in the crankcase 10 is performed early, delaying the progress of oil deterioration within the crankcase 10. As a result, the actual degree of oil deterioration becomes less than the degree of oil deterioration ΣB obtained by the oil life system, and the warning about the oil deterioration (issuance of the warning tone by the alarm device 16) might be performed earlier than the appropriate time.

However, when the increase correction is executed on the gas flow rate, the total oil carried amount ΣA is less than the optimum value KX. Consequently, the ratio (ΣA/KX) becomes less than "1.0." Therefore, the deterioration progress B is reduced by multiplying the ratio (ΣA/KX) by the deterioration progress B. In addition, the lower the total oil carried amount ΣA is than the optimum value KX, that is, the greater the divergence amount K2, the lower the ratio (ΣA/KX) is than "1.0." Thus, the amount of reduction correction performed on the deterioration progress B accurately corresponds to the divergence amount K2.

By calculating the degree of oil deterioration ΣB using the reduced deterioration progress B, the degree of oil deterioration ΣB is made in accordance with the actual degree of oil deterioration within the crankcase 10 that is suppressed from increasing as the gas flow rate is increased, and is similarly suppressed from increasing, as shown by the two-dot chain line L2 in FIG. 7. In this manner, it is possible to prevent the abovementioned problem in which the warning about the oil deterioration (issuance of the warning tone by the alarm device 16) is executed earlier than the appropriate time.

Note that when the results of the determination is negative in both steps S202 and S203, that is, when neither the reduction correction nor increase correction is performed on the gas flow rate, the processes of the steps S204 and S205 are skipped. Therefore, the deterioration progress B is not corrected by the amount corresponding to the divergence amount K1 or divergence amount K2.

According to this embodiment described above in detail, the following effects are attained. (1) The total oil carried amount ΣA of the oil carried from the crankcase 10 to the intake passage 3 by the blow-by gas from the start of the use of the engine 1 is calculated, and a determination processing is executed as to whether the total oil carried amount ΣA is greater or less than the optimum value KX thereof at the moment every time the travel distance of the automobile is increased by 100 km.

Then, when it is determined by the above determination process that the total oil carried amount ΣA is greater than the optimum value KX, the number of command steps R representing the operation command value of the PCV valve 14 that is calculated based on the engine operation state is reduced. The gas flow rate of the blow-by gas is reduced based on the corrected number of command steps R so as to correct the opening of the valve 14 to the closing side. As a result, the amount of oil carried from the crankcase 10 to the intake passage 3 by the blow-by gas is reduced, and the amount of deposit adhered to the intake passage 3 due to the oil can be prevented from exceeding the acceptable level.

When it is determined by the determination process that the total oil carried amount ΣA is less than the optimum value KX, the number of command steps R that is calculated based on the engine rotational speed and represents the operation command value of the PCV valve 14 is subjected to the increase correction until the next determination process is carried out. Then, by correcting the opening of the PCV valve 14 to the opening side on the basis of the corrected number of command steps R, the gas flow rate of the blow-by gas is subjected to increase correction. As a result, the blow-by gas within the crankcase 10 can be treated early, whereby the progression degree of oil deterioration within the crankcase 10 that is caused by the gas can be kept lower than the standard level.

The adhesion of the deposit to the intake passage 3 caused by the blow-by gas carrying the oil from the crankcase 10 to the intake passage 3 can be suppressed while the oil deterioration within the crankcase 10 can be suppressed by treating the blow-by gas early, by correcting the gas flow rate of the blow-by gas in the manner described above.

(2) When reduction correction is performed on the gas flow rate of the blow-by gas by reducing the number of command steps R, the degree of the reduction correction is made correspond to the divergence amount K1 for the optimum value KX of the total oil carried amount ΣA. As a result, the gas flow rate of the blow-by gas returned to the intake passage 3 is reduced significantly as the divergence amount K1 for the optimum value KX of the total oil carried amount ΣA increases. Accordingly, the oil carried amount A of the oil carried from the crankcase 10 to the intake passage 3 by the blow-by gas is reduced by the amount corresponding to the divergence amount K1 for the optimum value KX of the total oil carried amount ΣA. Therefore, the amount of deposit adhered to the intake passage 3 by the oil carried to the intake passage 3 can be appropriately prevented from exceeding the acceptable level, and the gas flow rate of the blow-by gas returned from the crankcase 10 to the intake passage 3 can be increased as much as possible, so that the deterioration of the oil within the crankcase 10 caused by the blow-by gas within the crankcase 10 can be suppressed as much as possible.

In addition, when increasing the gas flow rate of the blow-by gas by increasing the number of command steps R, the degree of the reduction correction is made correspond to the divergence amount K2 for the optimum value KX of the total oil carried amount ΣA. As a result, the gas flow rate of the blow-by gas returned to the intake passage 3 is increased significantly as the divergence amount K2 for the optimum value KX of the total oil carried amount ΣA increases. Accordingly, the blow-by gas within the crankcase 10 can be treated as early as possible, and the degree of deterioration progress of the oil within the crankcase 10 that is caused by the gas can be suppressed as low as possible with respect to the standard level. In addition, when increasing the gas flow rate, the amount of oil carried from the crankcase 10 to the intake passage 3 by the blow-by gas increases, but the amount of deposit adhered to the intake passage 3 is prevented from exceeding the acceptable level.

As described above, prevention of the adhesion of the deposit to the intake passage 3 and prevention of the oil deterioration within the crankcase 10 can be achieved at higher levels by setting the degrees of reduction correction and of increase correction of the gas flow rate to the degree corresponding to the divergence amount K1, K2 for the optimum value KX of the total oil carried amount ΣA.

(3) When the gas flow rate of the blow-by gas is reduced by reducing the number of command steps R, the treatment of the blow-by gas within the crankcase 10 is delayed, accelerating the progress of deterioration of the oil within the crankcase 10. As a result, the actual degree of oil deterioration becomes greater than the degree of oil deterioration ΣB obtained by the oil life system, whereby the oil life system might warn about the oil deterioration later than the appropriate time. However, when reducing the gas flow rate, the deterioration progress B calculated every predetermined period (16 ms) in order to obtain the degree of oil deterioration ΣB using the oil life system is increased. As a result, the degree of oil deterioration ΣB representing the accumulation of values obtained by calculating the deterioration progress B set to be greater in accordance with the actual degree of oil deterioration that is increased by the reduction correction performed on the gas flow rate. Thus, it is possible to prevent the above-mentioned problem in which the warning about the oil deterioration is performed later than the appropriate time.

In addition, when the gas flow rate of the blow-by gas is increased by increasing the number of command steps R, the treatment of the blow-by gas within the crankcase 10 is performed early, delaying the progress of deterioration of the oil within the crankcase 10. As a result, the actual degree of oil deterioration becomes less than the degree of oil deterioration ΣB obtained by the oil life system, whereby the oil life system might warn about the oil deterioration earlier than the appropriate time. However, when increasing the gas flow rate, the deterioration progress B calculated every predetermined period (16 ms) in order to obtain the degree of oil deterioration ΣB using the oil life system is reduced. As a result, the degree of oil deterioration ΣB representing the accumulation of values obtained by calculating the deterioration progress B is suppressed from increasing in accordance with the actual degree of oil deterioration that is suppressed from increasing as the gas flow rate is increased. Thus, it is possible to prevent the abovementioned problem in which the warning about the oil deterioration is performed earlier than the appropriate time.

(4) When the deterioration progress B is subjected to increase correction or reduction correction as the gas flow rate of the blow-by gas is subjected to reduction correction or increase correction, the degree of the correction is made correspond to the divergence amount K1, K2. As a result, the degree of the increase correction or reduction correction performed on the deterioration progress B is made correspond to the degree of the reduction correction or increase correction performed on the gas flow rate. Accordingly, the degree of oil deterioration ΣB obtained by the oil life system is made coincide with the actual degree of oil deterioration within the crankcase 10 that changes as the gas flow rate is subjected to the reduction correction or increase correction. Therefore, it is possible to prevent, more accurately, the oil life system from warning about the oil deterioration later or earlier than the appropriate time.

(5) Correction of the deterioration progress B by correcting the gas flow rate of the blow-by gas is carried out by calculating the ratio (ΣA/KX) between the total oil carried amount ΣA and the optimum value KX, and multiplying the deterioration progress B calculated based on the engine rotational speed and the engine load by the ratio (ΣA/KX). Here, the ratio (ΣA/KX) becomes larger than "1.0" as the total oil carried amount ΣA becomes greater than the optimum value KX, that is, the divergence amount K1 becomes larger. Moreover, the ratio (ΣA/KX) becomes lower than "1.0" as the total oil carried amount ΣA becomes lower than the optimum value KX, that is, the divergence amount K2 becomes larger. The deterioration progress is corrected by multiplying the ratio (ΣA/KX) having such characteristics by the deterioration progress B. As a result, the degree of the correction can be made correspond to the divergence amount K1, K2 accurately.

Note that the following modifications can be made to this embodiment.

The deterioration progress B can be subjected to the increase correction or reduction correction by multiplying the divergence amount K1 or the divergence amount K2 by a predetermined coefficient and adding/subtracting the resulting value to/from the deterioration progress B.

With regard to the increase correction and reduction correction performed on the deterioration progress B, the degree of the correction may be fixed regardless of the degree of the divergence amount K1 or K2. In this case, it is preferred that an experiment or the like be used previously to define optimum values as the increase correction amount and the reduction correction amount that are used in the abovementioned increase correction and reduction correction, and that the deterioration progress B be subjected to the increase correction or reduction correction based on these values (optimum increase correction amount and reduction correction amount).

The oil life system may not necessarily be provided.

Instead of defining the execution timing for executing the determination process based on the travel distance of the automobile, the execution timing can be defined based on the total operation hours that elapse since, for example, the start of activation of the engine 1. In this case, the execution timing for executing the determination process is set as a time point at which the total operation hours of the engine 1 reaches the time that is a factor of a predetermined hour, such as 1 hour.

With regard to the increase correction and reduction correction performed on the number of command steps R, the degree of the correction may be fixed regardless of the degree of the divergence amount K1 or K2. In this case, it is preferred that an experiment or the like be used previously to define optimum values as the increase correction amount and the reduction correction amount that are used in the abovementioned increase correction and reduction correction, and that the number of command steps R be subjected to the increase correction or reduction correction based on these values (optimum increase correction amount and reduction correction amount).

Instead of the one driven by a stepping motor, the one driven by an electromagnetic solenoid may be used as the electrically operated PCV valve 14.

What is claimed is:

1. A blow-by gas treatment apparatus for an internal combustion engine, which returns blow-by gas leaking out of a combustion chamber of the internal combustion engine into a crankcase, to an intake passage, and controls a gas flow rate of the blow-by gas on the basis of an engine operation state, the blow-by gas treatment apparatus comprising:

a calculation part that calculates a total amount of oil carried from the crankcase into the intake passage by the blow-by gas based on the engine operation state from the start of the use of the internal combustion engine;

a determination part that performs a determination process as to whether the total oil carried amount is greater or less than an optimum value at intervals of a predetermined operation period of the internal combustion engine; and a correction part that reduces the gas flow rate of the blow-by gas returned to the intake passage until next determination process is carried out when it is determined in the determination process that the total oil carried amount is greater than the optimum value, and that increases the gas flow rate until next determination process is carried out when it is determined in the determination process that the total oil carried amount is less than the optimum value.

2. The blow-by gas treatment apparatus for an internal combustion engine according to claim 1, wherein the correction part sets a degree of reduction or of increase of the gas flow rate of the blow-by gas that is returned to the intake passage to a degree corresponding to a divergence amount of the total oil carried amount with respect to the optimum value.

3. The blow-by gas treatment apparatus for an internal combustion engine according to claim 1, wherein an oil life system is applied to the internal combustion engine, the oil life system calculates, at intervals of a predetermined period, deterioration progress of the oil within the crankcase during each predetermined period based on the engine operation state, obtains a degree of oil deterioration by accumulating the deterioration progress each time the deterioration process is calculated, and warns about oil deterioration when the degree of oil deterioration becomes a threshold value or higher, and the correction part increases the deterioration progress when the gas flow rate of the blow-by gas that is returned to the intake passage is reduced, and reduces the deterioration progress when the gas flow rate is increased.

4. The blow-by gas treatment apparatus for an internal combustion engine according to claim 3, wherein the correction part sets a degree of reduction or of increase of the gas flow rate of the blow-by gas that is returned to the intake passage to a degree corresponding to a divergence amount of the total oil carried amount with respect to the optimum value, and sets a degree of increase or of reduction of the deterioration progress to the degree corresponding to the divergence amount.

5. The blow-by gas treatment apparatus for an internal combustion engine according to claim 4, wherein the correction part increases or reduces the deterioration progress by multiplying a ratio between the total oil carried amount and the optimum value by the deterioration progress.

6. The blow-by gas treatment apparatus for an internal combustion engine according to claim 2, wherein an oil life system is applied to the internal combustion engine, the oil system calculates, at intervals of a predetermined period, deterioration progress of the oil within the crankcase during each predetermined period based on the engine operation state, obtains a degree of oil deterioration by accumulating the deterioration progress each time the deterioration process is calculated, and warns about oil deterioration when the degree of oil deterioration becomes a threshold value or higher, and the correction part increases the deterioration progress when the gas flow rate of the blow-by gas that is returned to the intake passage is reduced, and reduces the deterioration progress when the gas flow rate is increased.

7. The blow-by gas treatment apparatus for an internal combustion engine according to claim 6, wherein the correction part sets a degree of reduction or of increase of the gas flow rate of the blow-by gas that is returned to the intake passage to a degree corresponding to a divergence amount of the total oil carried amount with respect to the optimum value, and sets a degree of increase or of reduction of the deterioration progress to a degree corresponding to the divergence amount.

8. The blow-by gas treatment apparatus for an internal combustion engine according to claim 7, wherein the correction part increases or reduces the deterioration progress by multiplying a ratio between the total oil carried amount and the optimum value by the deterioration progress.

* * * * *